US006873307B2

(12) United States Patent
Nitta et al.

(10) Patent No.: US 6,873,307 B2
(45) Date of Patent: Mar. 29, 2005

(54) DISPLAY APPARATUS

(75) Inventors: Tatsuhisa Nitta, Ishikawa (JP); Osamu Kawagoshi, Ishikawa (JP); Noritaka Imamaki, Ishikawa (JP)

(73) Assignee: Eizo Nanao Corporation, Ishikawa (JP)

( * ) Notice: Subject to any disclaimer, the term of this patent is extended or adjusted under 35 U.S.C. 154(b) by 194 days.

(21) Appl. No.: 09/739,737

(22) Filed: Dec. 20, 2000

(65) Prior Publication Data

US 2001/0004257 A1 Jun. 21, 2001

(30) Foreign Application Priority Data

Dec. 21, 1999 (JP) ..... 11-362345

(51) Int. Cl.[7] ..... G09G 5/00

(52) U.S. Cl. ..... 345/3.1; 345/204; 345/522; 710/20; 710/21

(58) Field of Search ..... 345/3.1, 204, 522, 345/501; 710/16, 20, 21, 63

(56) References Cited

U.S. PATENT DOCUMENTS 5,159,683 A * 10/1992 Lvovsky et al. ..... 395/500
5,502,808 A * 3/1996 Goddard et al. ..... 395/162
5,764,547 A 6/1998 Bilich et al.
6,049,316 A * 4/2000 Nolan et al. ..... 345/1
6,175,881 B1 * 1/2001 Tanagawa ..... 710/7
6,182,168 B1 * 1/2001 Guthrie ..... 710/52
6,314,479 B1 * 11/2001 Frederick et al. ..... 710/63
6,317,797 B2 * 11/2001 Clark et al. ..... 710/5
6,356,497 B1 * 3/2002 Puar et al. ..... 365/26
6,378,008 B1 * 4/2002 Gradinariu ..... 710/7
6,600,747 B1 * 7/2003 Sauber ..... 370/395.64
6,618,773 B1 * 9/2003 Chang et al. ..... 710/16

OTHER PUBLICATIONS

"Digital Visual Interface DVI" Paper Digital Display Working Group, XX, Apr. 2, 1999, pp. 1–76.
European Search Report May 13, 2002.

* cited by examiner

*Primary Examiner*—Alexander Eisen
*Assistant Examiner*—Kimnhung Nguyen
(74) *Attorney, Agent, or Firm*—Rader, Fishman & Grauer PLLC

(57) ABSTRACT

A display apparatus for displaying images based on signals received from a host. The apparatus includes a determining means for determining an interface type of the host, a plurality of storage means each storing specification information relating to display for one of interface types to be connected, and an output means for outputting, from one of the storage means to the host, the specification information corresponding to the interface type determined by the determining means.

8 Claims, 3 Drawing Sheets

DISPLAY APPARATUS

BACKGROUND OF THE INVENTION (1) Field of the Invention

This invention relates to a display apparatus connected to a host such as a graphics card in a computer for displaying images based on signals from the host.

(2) Description of the Related Art

Interface with a D-Sub connector, which is a typical type of analog interface, is chiefly used to connect a graphics card in a computer with a display apparatus.

The D-Sub connector is also called a 15-pin D-Shell display connector, a standard 15-pin VGA (Video Graphics Adapter) connector, or a VGA connector confirming to MIL-C-24308 Standard. In this specification, it will be called a VGA connector and the type of analog interface using this connector will be called a VGA interface. In this case, digital signals are converted to analog signals in the graphics card and the analog signals are transmitted to the display apparatus. The display apparatus processes the analog signals therein to display images.

Recently, it has become technically possible that display apparatus such as liquid crystal display apparatus accept digital signals as they are, and process and visualize these signals. Along with this trend, DVI-I, a digital interface using a new connector which is quite different from the VGA connector in shape, has been developed, and display apparatus having such interface are becoming commercially available.

DVI-I is the abbreviation of Digital Visual Interface Integrated which is the interface type that handles both TMDS (Transition Minimized Differential Signaling) digital signals and RGB (red, green and blue) analog signals.

A display apparatus having the DVI-I interface has a problem such that it cannot be physically connected to the graphics card having the VGA interface without a VGA/DVI-I conversion cable.

Even if the display apparatus is physically connected to the graphics card by using such a conversion cable, there is still another problem as mentioned hereinafter.

A computer operating system (hereinafter called an OS) today performs what is known as the Plug-and-Play function. Thus, when a Plug-and-Play compatible display apparatus is connected to a graphics card in a computer, the OS of the computer selects a driver (software) appropriate for display of images and automatically makes optimal settings for proper display.

To realize this function, the Plug-and-Play compatible display apparatus has specification information already stored in its memory, which is to be transmitted to the graphics card. This specification information is called EDID (Extended Display Identification Data), and includes, for example, the resolution, frequency of vertical scan signals, frame rate, vender code indicating the manufacturer's name, and the serial number of the display apparatus. Naturally, this information varies with models of display apparatus. Even display apparatus of the same model may have different information according to the interface type employed by the display apparatus.

Consequently, even when a graphics card having the VGA interface and a display apparatus having the DVI-I interface are connected through the conversion cable, EDID may not be transmitted normally to the graphics card. Even when EDID is transmitted, the Plug-and-Play function may not be performed normally. Then, no images will be displayed on the screen of the display apparatus, or appropriate display will not be achieved according to the specification of the display apparatus.

SUMMARY OF THE INVENTION

This invention has been made having regard to the state of the art noted above, and its object is to provide a display apparatus for selectively outputting appropriate specification information corresponding to the interface type on the host side to display images properly according to the specifications.

The above object is fulfilled, according to this invention, by a display apparatus for displaying images based on signals received from a host, comprising a determining means for determining an interface type of the host, a plurality of storage means each storing specification information relating to display for one of interface types to be connected, and an output means for outputting, from one of the storage means to the host, the specification information corresponding to the interface type determined by the determining means.

Signals from the host such as a graphics card in a computer reflect the interface type of the host. The determining means can determine the interface type from these signals. Alternatively, the user may manually operate a selector switch or the like, whereby the determining means may determine the interface type based on the state of the switch. The output means outputs specification information corresponding to the interface type determined, from one of the storage means to the host. Consequently, the host can make optimal settings for proper display according to the specification information.

Thus, according to this invention, the display apparatus can display images properly according to its specification even when the interface type of the host is different from that of the display apparatus.

Preferably, the determining means is arranged to discriminate between the latest DVI-I interface and the conventional VGA interface.

In this case, the output means outputs appropriate specification information corresponding to the interface type, whichever is employed by the host, so that images can be displayed properly according to the specification of the display apparatus.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Preferred embodiments of the present invention will be described in detail hereinafter with reference to the drawings.

Figure 1:
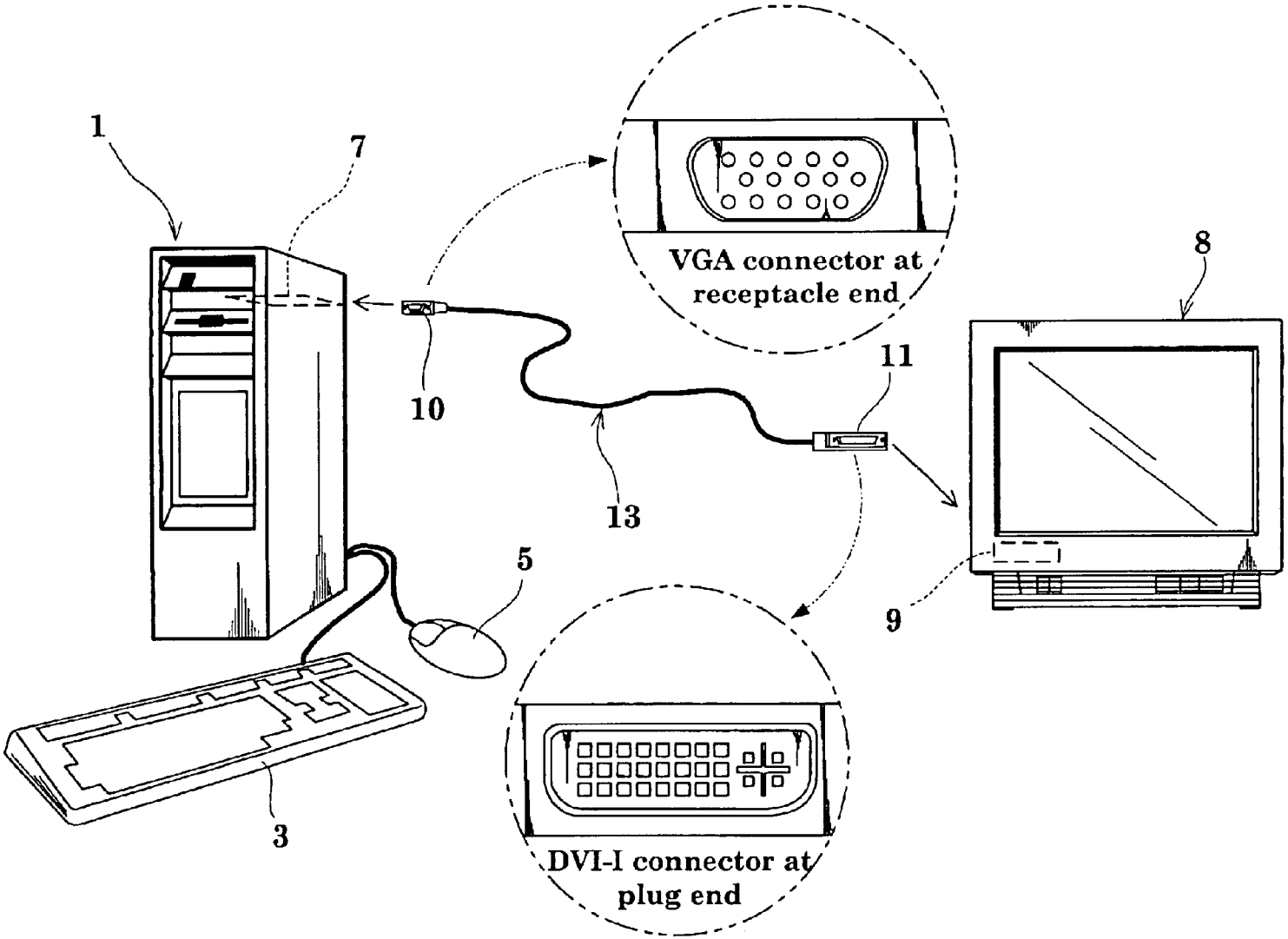
FIG. 1 is an overall view of a computer system including a display apparatus according to this invention.

Referring to FIG. 1, a computer 1 has a keyboard 3 and a mouse 5 connected thereto for inputting instructions and the like. The computer 1 outputs images and other data to a display 8 through a graphics card 7 inserted into an extended slot of the computer 1. The display 8 has a receptacle 9 formed adjacent to the rear thereof for receiving a DVI-I connector for the DVI-I interface.

The graphics card 7 corresponds to the host of this invention. This graphics card 7 may be the VGA interface type, or the DVI-I interface type.

Where the interface type is different, signals from the graphics card 7 and a voltage to a DC power line are different. Specification information called EDID is also different, which is outputted from the display 8 to the graphics card 7 to allow proper display of images on the display 8. The EDID acts on the OS of computer 1 most effectively where the OS supports the Plug-and-Play function.

Where, for example, the graphics card 7 employs the VGA interface and the display 8 employs the DVI-I interface, the graphics card 7 and display 8 must be connected through a conversion cable 13 having, at both ends thereof, a VGA connector acting as a receptacle 10 and a DVI-I connector acting as a plug 11. The DVI-I connector 11 has a 5V line for DDC (Display Data Channel) which is grounded as described hereinafter.

Where both the graphics card 7 and the display 8 employ the DVI-I interface, the graphics card 7 and display 8 may be connected through a usual video cable, i.e. one for the DVI-I interface.

Figure 2:
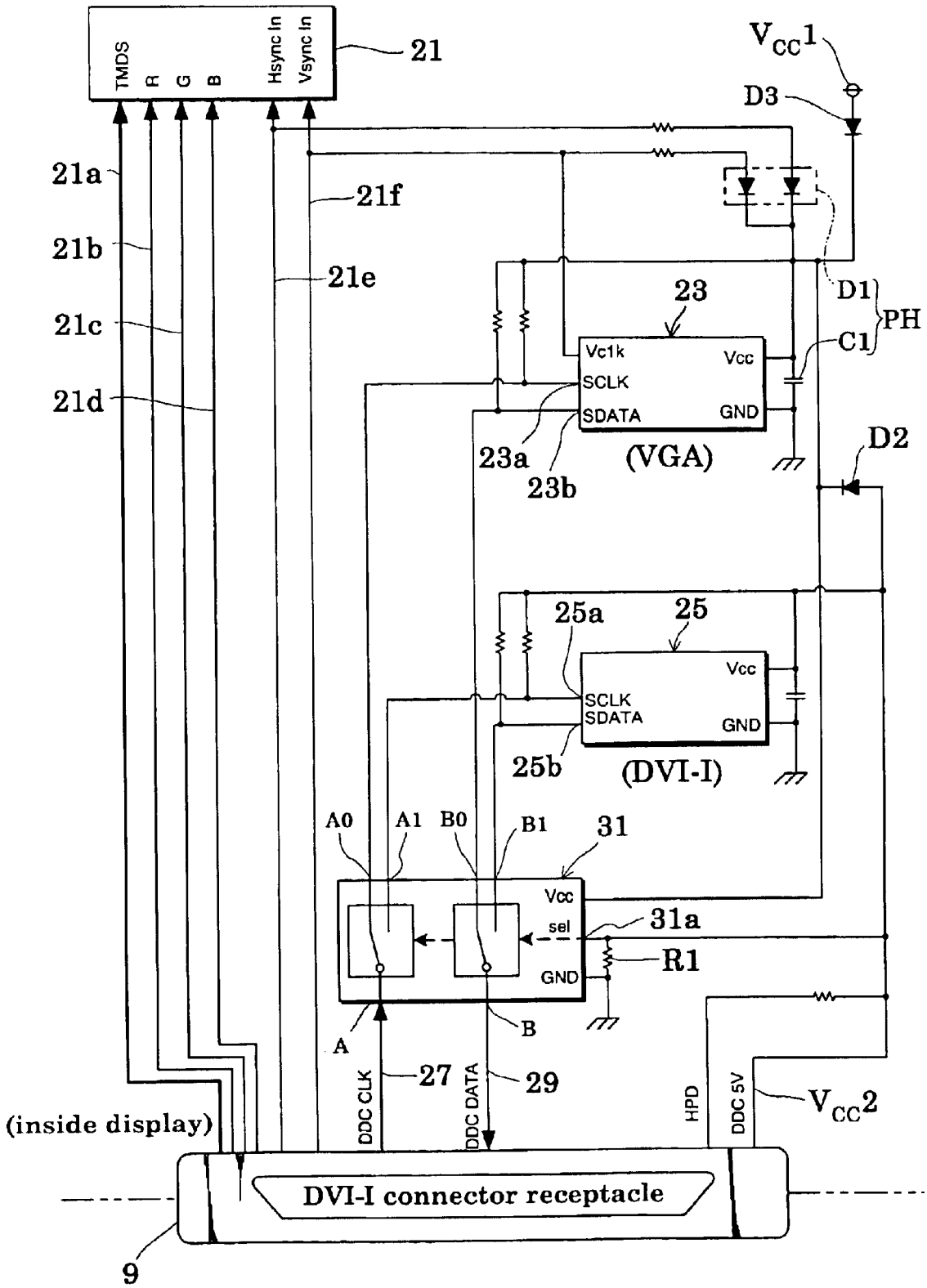
FIG. 2 is a block diagram of a principal portion of the display apparatus.

The display 8 includes a display screen such as a liquid crystal display screen, and an ASIC 21 for controlling this display screen (FIG. 2). The ASIC 21 has a TMDS signal line 21*a* which is a digital signal line, RGB signal lines 21*b*–21*d*, a horizontal synchronizing signal line 21*e* and a vertical synchronizing signal line 21*f*, all extending from the DVI-I connector receptacle 9 to the ASIC 21. Through this ASIC 21 signals are exchanged between various components (not shown) of the display 8.

The display 8 includes two EDID storage memories 23 and 25 which correspond to the storage means of this invention. The EDID storage memory 23 is for the VGA interface and the EDID storage memory 25 is for the DVI-I interface. These memories 23 and 25 store EDID corresponding to the respective interfaces. Synchronously with a clock from a DDC clock line 27 received at serial clock terminals 23*a* and 25*a*, the memories 23 and 25 output the EDID from serial data terminals 23*b* and 25*b* to a DDC data line 29.

The storage means are not limited to the two EDID storage memories 23 and 25. The number of memories may be varied with the number of interface types to be accommodated. Each memory may be selected for each interface type by a multiplexer 31.

The serial clock terminals 23*a* and 25*a* of EDID storage memories 23 and 25 are connected to input terminals A0 and A1 of multiplexer 31. The serial data terminals 23*b* and 25*b* are connected to input terminals B0 and B1 of multiplexer 31. Output terminals A and B of multiplexer 31 are selectively connected to the input terminal A0 or A1 and the input terminal B0 or B1, respectively, according to a voltage at a selector terminal 31*a*. In this embodiment, when the voltage at the selector terminal 31*a* is "0V" or thereabout, the output terminals A and B are connected to the input terminals A0 and B0, respectively. When the voltage is "5V" or thereabout, the output terminals A and B are connected to the input terminals A1 and B1, respectively.

The multiplexer 31 corresponds to the determining means and output means of this invention.

A power line Vcc1, which is connected to the primary source of display 8 for supplying 5V DC voltage, is connected to the EDID strage memory 23 and to the multiplexer 31 through a backflow preventing diode D3 which prevents reverse flow of current. Power is constantly supplied to the EDID storage memory 23 and multiplexer 31 during the operation of the display 8, including the operation in a power save mode. The horizontal synchronizing signal line 21*e* and vertical synchronizing signal line 21*f* are connected to the power terminal of EDID storage memory 23 through a rectifier diode D1. The rectifier diode D1 forms a peak hold circuit PH in combination with a capacitor C1 connected between the power terminal and a grounding terminal. That is, when the power line Vcc1 is at "0V", power needed for the operation is obtained from the graphics card 7.

A power line Vcc2 (5V line for DDC) is connected to the selector terminal 31*a* of multiplexer 31, and is grounded through a resistor R1. Consequently, even when the power line Vcc2 is opened instead of being grounded, the selector terminal 31*a* is forcibly reduced to "0V" unless a voltage is applied.

Further, the power line Vcc2 is connected directly to the power terminal of EDID storage memory 25, and through a DC backflow preventing diode D2 to the power terminal of EDID storage memory 23. This backflow preventing diode D2 prevents a current from the peak hold circuit PH from flowing into the power line Vcc2. The backflow preventing diode D2 also prevents the current from flowing to the selector terminal 31*a* of multiplexer 31 in order not to reverse the operation of multiplexer 31.

Figure 3:
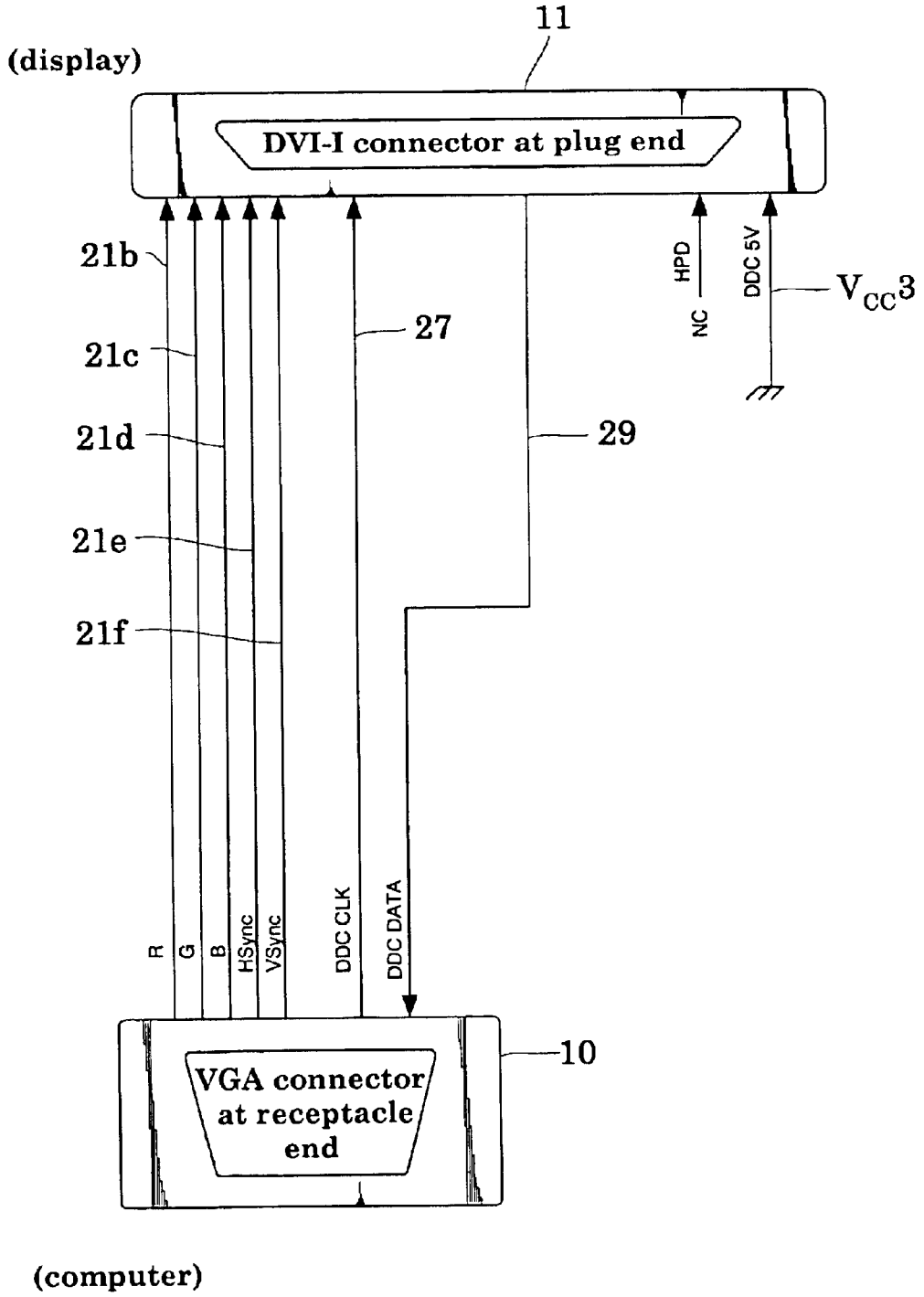
FIG. 3 is a view showing a conversion cable.

Referring to FIG. 3, the conversion cable 13 extends between the DVI-I connector 11 and the VGA connector 10. The DVI-I connector 11 has a power line Vcc3 (5V line for DDC) which is grounded.

For the reason noted hereinbefore, this power line Vcc3 may be opened instead of being grounded.

The RGB signal lines 21*b*–21*d*, horizontal synchronizing signal line 21*e*, vertical synchronizing signal line 21*f*, DDC clock line 27 and DDC data line 29 are connected to the corresponding terminals of the DVI-I connector 11 and the VGA connector 10.

Operation of the apparatus having the above construction will be described next.

DVI-I Connector

Where the graphics card 7 has a connector of the DVI-I interface, the graphics card 7 and display 8 are connected through a digital video cable (not shown) having DVI-I connectors at both ends thereof.

In this case, 5V voltage for DDC is supplied to the power line Vcc2 to supply power to the multiplexer 31 and is also supplied to both EDID storage memory 23 and EDID storage memory 25, thereby activating the two memories 23 and 25. The 5V voltage is applied to the selector terminal 31*a* of multiplexer 31.

Consequently, the input terminals A1 and B1 of multiplexer 31 are selected and only the operative state of the EDID storage memory 25 is transmitted to the graphics card 7 even though both EDID storage memories 23 and 25 are activated.

When Power to the Display is Off

When power supply to the display 8 is completely cut off, the power line Vcc1 becomes "0V". However, power is supplied from the power line Vcc2 to the EDID storage memory 25 and to the multiplexer 31. Consequently, even though the display 8 is turned off, the EDID is normally transmitted to the graphics card 7 to perform the Plug-and-Play function normally.

VGA Connector

Where the graphics card 7 has a connector of the VGA interface, the graphics card 7 and display 8 are connected through the conversion cable 13.

The display 8 supplies power to the power line Vcc1 to activate the EDID storage memory 23 and the multiplexer 31. Since the power line Vcc2 is grounded, the selector terminal 31*a* of multiplexer 31 becomes "0V", whereby it selects the input terminals A0 and B0. Consequently, the EDID is outputted from the EDID storage memory 23.

Since no power is supplied to the EDID storage memory 25 which is unnecessary in this case, a relatively small power capacity generated in the peak hold circuit PH will not be wasted.

When Power to the Display is Off

When power supply to the display 8 is completely cut off, except in the power save mode for reducing power consumption by the display 8, the power line Vcc1 becomes "0V".

However, the peak hold circuit PH supplies power to the EDID storage memory 23 and to the multiplexer 31.

Consequently, even though the display 8 is turned off, the EDID is normally transmitted to the graphics card 7 to allow proper display of images.

This invention is not limited to the construction in the foregoing embodiment, but may be modified as follows:

(1) In place of the above conversion cable, a simple VGA/DVI-I conversion cable not having, at its DVI-I end, any DDC 5V line which is opened or grounded may be used. In this case, the inputs to the multiplexer may be switched by manually operating a switch disposed at the rear of the display.

The DVI-I connector may have a projection or the like formed thereon. When this projection enters a recess formed at the rear of the display, a selector switch therein may be operated automatically to switch the inputs to the multiplexer.

(2) The storage means may be a single physical memory having an internal storage region logically divided to store EDID corresponding to a plurality of interface types. In this case, for example, the interface type may be determined by a microcomputer, and the EDID corresponding to the interface type may be retrieved from the memory and outputted in response to a serial clock detected by the microcomputer.

(3) The interface type is not limited to the described combination of the VGA interface and the DVI-I interface. The same advantages may be secured for other interface types by devising a way of distinguishing one type from another.

The present invention may be embodied in other specific forms without departing from the spirit or essential attributes thereof and, accordingly, reference should be made to the appended claims, rather than to the foregoing specification, as indicating the scope of the invention.

What is claimed is:

1. A display apparatus for displaying images based on signals received from a host, comprising:

determining means for determining an appropriate one of a plurality of interface types to connect the display apparatus and said host;

a plurality of storage means each storing specification information relating to the display for each one of the interface types to be connected, said plurality of storage means including two storage means, one for the DVI-I interface, and the other for the VGA interface, said storage means for the DVI-I interface being powered by said host only when the interface type is the DVI-I interface;

output means for switching between or among the plurality of storage means based upon the determination by the determining means and for outputting, from said storage means to said host, the specification information corresponding to the appropriate one of the interface types determined by said determining means; and a peak hold circuit for generating a DC voltage based on synchronizing signals received from said host, said DC voltage generated by said peak hold circuit being supplied only to said storage means for the VGA interface and to said multiplexer.

2. A display apparatus as defined in claim 1, further comprising a backflow preventing diode disposed between said peak hold circuit and said storage means for the DVI-I interface for blocking a DC current flowing from said peak hold circuit.

3. A selector apparatus for use with a computer including a graphics card having either a DVI-I connector or a VGA connector and a display device having a DVI-I connector, the graphics card and the display device interconnected to each other by a cable, the graphics card having a graphics card power source to provide a graphics card voltage and the display device having a display device power source only with the DVI-I connector to provide a display device voltage in the ON state and to provide zero voltage or approximately zero voltage in an OFF state, the selector apparatus comprising:

a first storage memory for storing specification information for a VGA interface;

a second storage memory for storing specification information for a DVI-I interface; and a multiplexer operably connected to the first and second storage memories and the graphics card and having a selector terminal for determining whether the graphics card voltage is present or absent such that when the graphics card voltage is determined to be present, the multiplexer outputs DVI-I specification information to the graphics card in order for the display device to properly display images in accordance with the specification information for the DVI-I interface and when the graphics card voltage is determined to be absent, the multiplexer outputs the specification information for the VGA interface to the graphics card in order for the display device to properly display images in accordance with the VGA specification.

4. A selector apparatus according to claim 3, wherein when the graphics card voltage is determined to be absent, power is supplied to activate the first storage memory and the multiplexer regardless if the display device is in the ON state or the OFF state.

5. A selector apparatus according to claim 4, wherein power is supplied to activate the first storage memory and the multiplexer from the display device power source when the display device power source is in the ON state.

6. A selector apparatus according to claim 4, further comprising a peak hold circuit operably connected the display device power source, the multiplexer and the first storage memory such that when the display device power source is in the OFF state, the peak hold circuit provides power to the first storage memory and the multiplexer so that the specification information for the VGA interface can be output to the graphics card.

7. A display apparatus for displaying images based on voltage signals received from a host, comprising:

determining means for determining an appropriate one of a plurality of interface types to connect the display apparatus and said host;

a plurality of storage means each storing specification information relating to the display for each one of the interface types to be connected; and output means for switching between or among the plurality of storage means based upon the determination by the determining means and for outputting, from said storage means to said host, the specification information corresponding to the appropriate one of the interface types determined by said determining means;

a peak hold circuit; and a backflow preventing diode, wherein:

said determining means is arranged to discriminate between the DVI-I (Digital Visual Interface Integrated) interface and the VGA (Video Graphics Adapter) interface, said plurality of storage means comprise two storage means, one for the DVI-I interface, and the other for the VGA interface, said storage means for the DVI-I interface being powered by said host only when the interface type is the DVI-I interface;

said peak hold circuit generates a DC voltage based on synchronizing signals received from said host, said DC voltage generated by said peak hold circuit being supplied only to said storage means for the VGA interface and to said multiplexer, said backflow preventing diode Is disposed between said peak hold circuit and said storage means for the DVI-I interface for blocking a DC current flowing from said peak hold circuit, said display apparatus is connected to said host through a VGA to DVI-I conversion cable having, at its DVI-I end, a 5V line for DDC (Display Data Channel) which is opened or grounded, and said specification information is EDID (Extended Display Identification Data) necessary for the Plug-and-Play function.

8. A display apparatus for displaying images based on signals received from a host, comprising:

determining means for determining an appropriate one of a plurality of interface types to connect the display apparatus and said host;

a plurality of storage means each storing specification information relating to the display for each one of the interface types to be connected;

a peak hold circuit; and output means including a multiplexer for switching between or among the plurality of storage means based upon the determination by the determining means and for outputting, from said storage means to said host, the specification information corresponding to the appropriate one of the interface types determined by said determining means, wherein said determining means is arranged to discriminate between the DVI-I (Digital Visual Interface Integrated) interface and the VGA (Video Graphics Adapter) interface, wherein said plurality of storage means comprise two storage means, one for the DVI-I interface, and the other for the VGA interface, said storage means for the DVI-I interface being powered by said host only when the interface type is the DVI-I interface, wherein the peak hold circuit generates a DC voltage based on synchronizing signals received from said host, said DC voltage generated by said peak hold circuit being supplied only to said storage means for the VGA interface and to said multiplexer; and wherein said specification information is EDID (Extended Display Identification Data) necessary for the Plug-and-Play function.

* * * * *